US007524355B2

(12) United States Patent
Dreizin et al.

(10) Patent No.: US 7,524,355 B2
(45) Date of Patent: Apr. 28, 2009

(54) NANO-COMPOSITE ENERGETIC POWDERS PREPARED BY ARRESTED REACTIVE MILLING

(75) Inventors: Edward Leonid Dreizin, Yardley, PA (US); Mirko Schoenitz, Princeton, NJ (US)

(73) Assignee: New Jersey Institute of Technology, Newark, NJ (US)

( * ) Notice: Subject to any disclaimer, the term of this patent is extended or adjusted under 35 U.S.C. 154(b) by 298 days.

(21) Appl. No.: 10/988,183

(22) Filed: Nov. 12, 2004

(65) Prior Publication Data

US 2006/0053970 A1 Mar. 16, 2006

Related U.S. Application Data

(60) Provisional application No. 60/524,702, filed on Nov. 24, 2003.

(51) Int. Cl.
*C21C 5/34* (2006.01)
*C21C 7/00* (2006.01)

(52) U.S. Cl. ..... 75/375; 75/376; 75/384; 75/386; 75/252; 75/351; 75/352; 75/354; 419/32; 419/33; 148/515; 148/513; 149/37

(58) Field of Classification Search ..... 75/354, 75/375; 419/33; 149/37
See application file for complete search history.

(56) References Cited

U.S. PATENT DOCUMENTS 2,569,956 A 10/1951 Schiltknecht
5,490,888 A 2/1996 Assel et al.
6,316,125 B1 11/2001 Gaman et al.

OTHER PUBLICATIONS

Blobaum et al., Deposition and characterization of a self-propogatingCuOx/Al thermite reaction in a multilayer foil geometry, Journal of Applied Physics, Sep. 1, 2003, 2915-22, vol. 94, No. 5.

Dufaux and Axelbaum, Nanoscale Unagglomerated nonoxide particles from a sodium coflow flame, Combustion and Flame, 1995 100:350-358.

Rosen et al., Synthesis of unagglomerated, non-oxide nanophase powders in a turbulent jet flame, Washington University, 1999, 164-167.

Tepper, Electro-explosion of wire produces nanosize metals, MPR Jun. 1998, 31-38.

Jiang and Yatsui, Pulsed Wire Discharge for Nanosize Powder Synthesis, IEEE Transactions on Plasma Science, Oct. 1998, 1498-1501 vol. 26, No. 3.

(Continued)

*Primary Examiner*—Roy King
*Assistant Examiner*—Christopher Kessler
(74) *Attorney, Agent, or Firm*—Klauber & Jackson, LLC

(57) ABSTRACT

A method is disclosed for producing an energetic metastable nano-composite material. Under pre-selected milling conditions a mixture of powdered components are reactively milled. These components will spontaneously react at a known duration of the pre-selected milling conditions. The milling is stopped at a time at which the components have been compositionally homogenized to produce nanocomposite powder, but prior to said known duration, and thereby before the spontaneous reaction occurs. The milled powder is recovered as a highly reactive nanostructured composite for subsequent use by controllably initiating destabilization thereof.

17 Claims, 5 Drawing Sheets

OTHER PUBLICATIONS

Wang et al., Preparation and characterization of nanocrystalline powders of Cu-Zn alloy by wire electrical explosion method, Materials Science & Engineering, 2001, A307 190-194.

Armstrong et al., Enhanced Propellant Cumbustion with Nanoparticles, Nano Letters, 2003, 253-255, vol. 3, No. 2.

Brousseau and Anderson, Nanometric Aluminum in Explosives, Propellants, Explosives, Pyrotechnics 2002, 300-306, vol. 27.

Jones et al, Hazard Characterization of Aluminum Nanopowder Compositions, Explosives, Pyrotechnics 2003, 120-131, vol. 28, No. 3.

Tillotson et al., Nanostructured energetic materials using sol-gel methodologies, Journal of Non-Crystalline Solids, 2001, 338-345, 285.

Maeng et al., Characterization and surface stabilization of aluminum nano powders produced by the pulses wire evaporation method, Journal of Metastable and Nanocrystalline Materials, 2003, 494-494, Vo. 15-16.

Sanchez-Lopez et al., Characterization of Passivated Aluminium Nanopowders: An XPS and TEM/EELS study, Journal of European Ceramic Society, 1998, 1195-1200, 18.

Lazlo Takacs, Self-sustaining reactions induced by ball milling, Progress in Matrials Science, 2002, 355-414, 47.

Munir and Anselmi-Tamburini, Self-Propogating exothermic reactions: the synthesis of high-temperature materials by combustion, University of California, 1998, 277-365.

C. Suryanarayana, Mechanical Alloying and Milling, Progress in Materials Science, 2001, 1-184, 46.

Shoshin et al., Preparation of characterization of Energetic Al-Mg Mechanical Alloy Powders, Combustion and Flame, 2002, 259-269, 128.

Schoenitz et al., Constant Volume Explosions of Aerosols of Metallic Mechanical Alloys and Powder Blends, Journal of Propulsion and Power, 2003, 405-412, vol. 19, No. 3.

Trunov et. al., Ignition of Al-Mg Mechanical Alloys, Chemical and Physical Processes In Combustion, The Pennsylvania State University, 2003, p. 313-332.

Trunov et. al., Ignition of Al-Mg Mechanical Alloys, The 2003 Technical Meeting of the Eastern States Section of the Combustion Inst. Univ. Park, PA (2003) pp. 313-316.

Mohan et al., Characterization of Aluminum Powder Ignition, The 2003 Technical Meeting of the Eastern States Section of the Combustion Inst. Univ. Park, PA (2003) pp. 329-332.

M.J. Starink, A new method for the derivation of activation energies from experiments performed at constant heating range, Thermochimica Acta, 1996, 97-104, vol. 288.

Delogu et al., A novel macrokinetic approach for mechanochemical reactions, Chemical Engineering Science, 2003, 815-821, vol. 58.

NANO-COMPOSITE ENERGETIC POWDERS PREPARED BY ARRESTED REACTIVE MILLING

RELATED APPLICATION

This application claims priority from U.S. Provisional Patent Application Ser. No. 60/524,702, filed Nov. 24, 2003.

GOVERNMENT LICENSE RIGHTS

The United States government may hold license and/or other rights in this invention as a result of financial support provided by governmental agencies in the development of aspects of the invention.

FIELD OF INVENTION

This invention relates generally to energetically reactive compositions, and more specifically relates to the preparation of metastable nano-composite materials by arrested reactive milling.

BACKGROUND OF INVENTION

A very high reaction enthalpy is an advantage of composite energetic formulations employing metallic fuels and solid oxidizers. However, the rates of reaction of such formulations are limited by condensed phase transport processes and are much lower than the reaction rates of mono-molecular energetic formulations, e.g., TNT, HMX, RDX, etc. Current research on composite energetics aims to reduce the length scales limiting mass transfer rates and to approach the reaction kinetics achievable for monomolecular formulations. Significant efforts have been made to produce metal fuel powders with nano-sized particles, see e.g., [D. P. Dufaux, R. L Axelbaum, *Combustion and Flame* 100 (1995) 350-358; L. J. Rosen, Z. Sun, R. L. Axelbaum, *Chemical and Physical Processes in Combustion* Combustion Institute, Raleigh, N.C., 1999, pp. 164-167]. Faster burning rates have been demonstrated with nano-sized metal powders for several applications, however difficulties in handling such powders and their incorporation into existing formulations have also been reported [P. Brousseau, J. C. Anderson, *Propellants, Explosives, Pyrotechnics* 27(5) (2002) 300-306]. To benefit fully from the small length scale and large specific surface of nano-sized metal particles, such particles should be intimately mixed with similarly sized oxidizer particles. Progress in this direction has been reported and nanopowders of metals and metal oxides have been mixed in organic solvents forming so-called Metastable Intermolecular Composites (MIC) [N. Bockmon, S. F. Son, B. W. Asay, J. R. Busse, J. T. Mang, P. D. Peterson, M. Pantoya, *CPIA Publication* 712 (38th JANNAF Combustion Subcommittee Meeting) (2002) 613-624]. Sol-gel processing has also been developed to produce nano-structured matrices of oxidizer materials that can be filled with metallic nano-sized fuels [T. M. Tillotson.; A. E. Gash, R. L. Simpson, L. W. Hrubesh, J. H. Satcher, J. F. Poco, *Journal of Non-Crystalline Solids* 285(1-3) (2001) 338-345].

In all of the current approaches, metal nanopowders have to be synthesized in a separate process and then mixed with the oxidizer. Handling of the highly reactive nano-sized fuel particles in close contact with oxidizer is needed and some passivation is always required. In order to reduce ignition sensitivity of metal nano-powders, protective coatings are used [D. Y Maeng, C. K Rhee, W. W. Kim, K. H Kim, Y. A. Kotov, *Journal of Metastable and Nanocrystalline Materials* 15-16 (2003) 491-494], which typically reduce the overall enthalpy of the fuel. Nano-sized ingredient powders also make it difficult to achieve the desired high density of the final energetic formulations. In addition, the costs of synthesis, passivation, and handling of the fuel and oxidizer nanopowders are currently prohibitively high.

SUMMARY OF INVENTION

Now in accordance with the present invention, nano-structured composite energetic materials are provided by use of arrested reactive milling of powdered mixture of metals and oxidizers for the metals, or by such milling of mixtures of reactive metals. The resulting materials are micron-sized powders, which can be handled using conventional processing techniques. Each particle comprises a fully dense mixture of the reagents with a three-dimensional nanosized structure. The components can be a fuel and oxidizer, e.g., thermite compositions, or highly reactive combinations of metals, e.g., B—Ti, B—Zr or others. Fresh metal surface is produced during synthesis but most of it is never exposed to oxidizing environment, unlike the fresh metal surface of the nanosized metal powders. The interface between the reactants is formed at low temperatures and therefore, the passivating layers are not produced on the fresh metal surfaces to the same degree as for blends of nanometer sized powders or layered nanocomposites produced at elevated temperatures by sputter deposition [K. J. Blobaum, M. E. Reiss, J. M. Plitzko Lawrence, and T. P Weihs, *Journal of Applied Physics* 94(5) 2003 2915-2922].

Reactive Milling has been observed to trigger spontaneous combustion-like reactions in a number of reactive systems. Such a spontaneous reaction is likely if the adiabatic reaction temperature of the components exceeds 1800° K [L. Takacs, *Progress in Materials Science* 47: 355-414 (2002) Z. A Munir, U. Aselmi-Tamburini, *Materials Science Reports,* 3(7-8) (1989) 277-365]. Such spontaneous reactions show very high reaction rates desirable for many applications of energetic materials. In the present invention reactive milling is adapted to prepare highly reactive composites. Such materials are obtained just before the spontaneous reaction would have occurred during milling so that the reaction can be controllably initiated later. In order to prepare such materials, the time of spontaneous initiation must be known as accurately as possible. Current theoretical treatment of the milling process is not sufficiently advanced to predict initiation reliably. Therefore, in the process of the invention a parametric experimental investigation establishes the conditions leading to the spontaneous reaction for each composition of interest.

Thus in accordance with the invention, a method is disclosed for producing an energetic metastable nano-composite material. Under pre-selected milling conditions a mixture of powdered components are reactively milled. These components will spontaneously react after a known time duration specific for the pre-selected milling conditions. The milling is stopped at a time at which the components have been compositionally homogenized to produce nanocomposite particles, but prior to said known duration, and thereby before the spontaneous reaction occurs. The milled powder is recovered as a highly reactive nanostructured composite for subsequent use by controllably initiating destabilization thereof. During recovery and handling, only the external surface of the particles is exposed to oxygenated environment and passivated by oxidation. Most of the freshly produced reactive metal interfaces remain within the nanocomposite material and retains its high reactivity.

In a preferred procedure for practicing the invention the milling is effected in a ball mill, where the pre-selected conditions include the number of balls; the ball diameter and ball material; the ratio between the ball diameter and initial volume of the components being milled; the ratio between the mass of balls and the mass of the said components; the material, size, and shape of the milling container; the presence or absence of milling aids such as surfactants; and the mill operating parameters used during the milling operation, which for example in a vibratory ball mill would include oscillating rate and amplitude. On the other hand, in a stirred mill such as the "Attritor", rotational speed of the stirrer is such an operating parameter. Similarly, in a planetary mill rotational speed of the milling vial is such an operating parameter.

BRIEF DESCRIPTION OF DRAWINGS

The invention is further illustrated in the Figures appended hereto, in which.

DESCRIPTION OF PREFERRED EMBODIMENT

Figure 1:
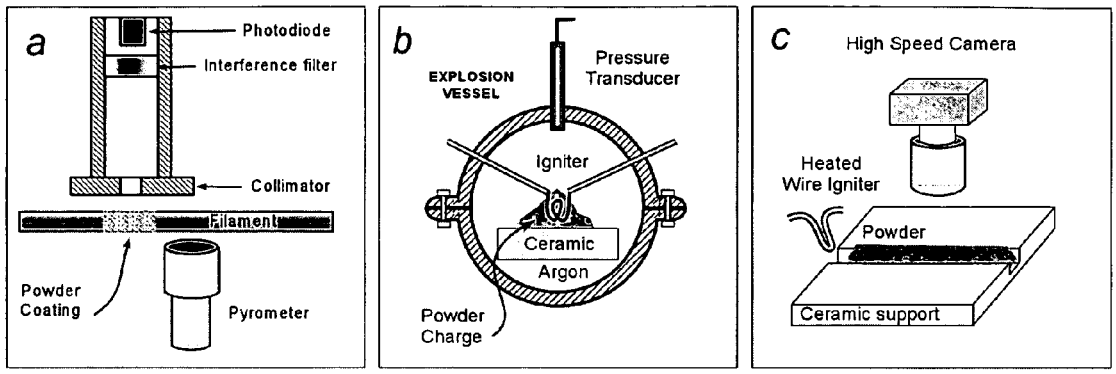
FIG. 1 schematically illustrates experimental configurations used for preliminary ignition and combustion tests of the synthesized energetic nano-composite powders: (a) Heated filament ignition; (b) Constant volume explosion; (c) Linear burning rate.

The invention is further illustrated in the following Examples, which however are to be considered as exemplary and not definitive of the invention.

EXAMPLE 1

A SPEX 8000 shaker mill has been used extensively in current research on reactive milling and mechanical alloying [C. Suryanarayana, *Progress in Materials Science,* 46 (2001) 1-184; Y. L. Shoshin, R. S. Mudryy, E. L. Dreizin, *Comb. Flame* 128 (2002) 259-269; M. Schoenitz, E. L. Dreizin, E. Shtessel, *J. of Prop. and Power* 19(3) (2003) 405-412] and was also used in this and the other Examples. The SPEX shaker mill is a vibratory mill; its vial is agitated at high frequency in a complex cycle that involves motion in three orthogonal directions. The reciprocating velocity of the vial in the SPEX 8000 series shaker mill is directly proportional to the motor's rotational speed. Under various loading conditions, the rotational speed of the actuator input shaft was measured with a stroboscope. The nominal rotational speed was 1054 RPM, which translates to an oscillation frequency of 17.6 Hz. The vial speed was not varied in the present Examples, but it offers additional means of control over the milling process as the vial speed directly influences the impact velocity and frequency of collisions, and hence the energy transferred to the powder from the plastic deformation. Steel milling vials and balls were used in this and the remaining Examples. Milling media with higher or lower densities can also be used to afford control over the collision energy between the media.

A thermistor was mounted on the milling vial and connected to a PC-based data logger to monitor its temperature. The spontaneous reaction registered as a sharp temperature spike. Times of initiation were determined for varying milling parameters for each material. No process control agent was used. The diameters of the balls used were 2.36, 3.16, 4.76, and 9.52 mm. The materials were milled under argon. The ball-to-powder weight ratio (charge ratio, $C_R$) was set to 2.5, 5, and 10.

Starting materials were Al (98%, 10-14 μm), $Fe_2O_3$ (99.5%, −325 mesh), and $MoO_3$ (99.95%, −325 mesh) from Alfa Aesar. The total amount of material was 5 g in the case of Al—$Fe_2O_3$, and 2 g for Al—$MoO_3$. At a given $C_R$, this changes the number of balls used, and therefore the milling times required to initiate the spontaneous reaction for different materials are not immediately comparable. The amount of the Al—$MoO_3$ mixture loaded in a single run did not exceed 2 g to avoid damaging the milling vial because of the high local temperatures caused by the reaction.

After initiation times were determined, samples of metastable composite materials were prepared using Arrested Reactive Milling (ARM) by halting the milling just before the initiation of the reaction. Stoichiometric Samples of Al—$Fe_2O_3$ and Al—$MoO_3$ were prepared with varying milling times. The respective reproducibility of the initiation under identical milling conditions was found to be about 10% (see below). Therefore, samples arrested at approximately 90% of the time of spontaneous initiation are designated as "fully milled" for reference. Partially milled samples were obtained at approximately 50% initiation time.

Materials Characterization

Powder x-ray diffraction was performed using a Philips X'pert MRD X-ray diffractometer. The surface morphology of individual particles as well as the internal structure of cross-sectioned particles was investigated using a LEO 1530 Field Emission Scanning Electron Microscope (SEM). Cross sections were prepared by embedding small quantities of composite powders in epoxy resin. The particles were embedded under vacuum to eliminate trapped gasses and avoid formation of bubbles. The mounts were then polished by hand using successively finer SiC polishing paper up to 1200 grit.

Particle size distributions for starting materials, mechanical alloys and their combustion products were determined by Low-Angle Laser Light Scattering (LALLS) using a Coulter LS230 particle size analyzer.

EXAMPLE 2

Combustion Testing

Several preliminary tests were carried out to assess changes in the ignition and combustion behavior of the nanocomposite thermite materials produced by ARM. Schematic diagrams of the experimental setups are shown in FIG. 1.

Ignition of the ARM-prepared powders was studied using an electrically heated filament (FIG. 1*a*). This technique has been described extensively elsewhere [M. A. Trunov, M. Schoenitz, E. L. Dreizin, *Chemical and Physical Processes in Combustion*. The 2003 Technical Meeting of the Eastern States Section of the Combustion Institute University Park, Pa., (2003) pp. 313-316; S. Mohan, M. A. Trunov, E. L. Dreizin, *Chemical and Physical Processes in Combustion*. The 2003 Technical Meeting of the Eastern States Section of the Combustion Institute University Park, Pa., (2003) pp. 329-332]. A thin layer of powder is coated on a conductive filament, which is electrically heated at varying rates. Ignition of the powder is registered using a photodiode focused on the powder coating. The temperature of the filament is measured simultaneously with an infrared pyrometer focused on an uncoated area of the filament adjacent to the powder. This setup minimizes errors due to unknown emissivities of different powders. From the ignition temperatures measured in this setup at different heating rates, the activation energy can be estimated by treatment analogous to isoconversion methods used in conventional thermal analysis [M. J. Starink, *Thermochimica Acta* 288 (1996) 97-104].

In another test, reaction rates were compared for nano-composite powders prepared using ARM and blended initial component powders. In these tests, the thermite powder was placed on a ceramic support inside a closed pressure vessel equipped with a pressure transducer (FIG. 1*b*). Prior to the experiment, the vessel was purged with argon. The powder charge was ignited using a heated wire. The powder was not dispersed prior to ignition. However, most of the powder was airborne during the combustion due to the expansion of surrounding and pore gas as well as due to the production of intermediate volatile products. Pressure traces were recorded, and combustion products were collected for x-ray phase analysis.

Linear burning rates of different powders were measured in the test illustrated in FIG. 1*c*. The powders were placed in an open, rectangular groove of 2.5×2.5 mm cross-section cut into a block of ceramic. Samples were initiated on one end with an electrically heated wire. The propagation of the combustion front was recorded with a high-speed video camera at 500 frames per second.

Results and Discussion

Synthesis of the Reactive Nano-Composite Powders

Observed times of spontaneous initiation during milling of Al—$MoO_3$ and Al—$Fe_2O_3$ are shown in Table 1. The values and errors shown are the results of 2 -4 repetitions under identical conditions. The reproducibility is found to be on the order of ±10%. Milling times generally decrease with increasing charge ratio $C_R$.

TABLE 1

Milling times (minutes) required for spontaneous initiation of stoichiometric mixtures of Al—$MoO_3$ and Al—$Fe_2O_3$ for specific ball sizes and charge ratios.

| Ball size, mm | $C_R = 2.5$ | $C_R = 5$ | $C_R = 10$ |
|---|---|---|---|
| Al—$MoO_3$ | | | |
| 2.36 | 39.2 ± 1.1 | 33.2 ± 1.8 | 7.75 ± 0.21 |
| 3.16 | 24.2 ± 2.4 | 13.9 ± 0.1 | 7.05 ± 0.07 |
| 4.76 | 22.8 ± 0.8 | 11.4 ± 0.6 | 5.85 ± 0.07 |
| 9.52 | 35.4 ± 6.4 | 9.65 ± 0.9 | 4.60 ± 0.14 |

TABLE 1-continued

Milling times (minutes) required for spontaneous initiation of stoichiometric mixtures of Al—$MoO_3$ and Al—$Fe_2O_3$ for specific ball sizes and charge ratios.

| Ball size, mm | $C_R = 2.5$ | $C_R = 5$ | $C_R = 10$ |
|---|---|---|---|
| Al—$Fe_2O_3$ | | | |
| 2.36 | 169 ± 94 | 14.8 ± 1.1 | 8.93 ± 0.64 |
| 3.16 | 59.0 ± 7.1 | 18.1 ± 0.5 | 9.47 ± 0.39 |
| 4.76 | 41.6 ± 4.1 | 20.5 ± 3.6 | 10.0 ± 1.03 |
| 9.52 | 33.6 ± 4.3 | 11.7 ± 4.3 | 9.42 ± 0.74 |

Recently, it has been suggested that the progress of mechanical alloying or reactive milling can be described using the specific milling dose, $D_m$, introduced as $$D_m = \frac{I \cdot t}{m_p} \approx \frac{n_{coll} E_{coll} t}{m_p} \tag{1}$$

where I is the milling intensity, $n_{coll}$ is the frequency of ball-ball collisions, $E_{coll}$ the averaged energy per collisions, t the milling time, and $m_p$ the powder mass [F. Delogu, R. Orrhu, G. Cao, *Chemical Engineering Science* 58 (2003) 815-821]. It was assumed that the value of $D_m$, determines the state of the milled material, and that ignition is triggered at a specific degree of grain refinement. Further simplifying assumptions can be made, i.e., $E_{coll} \sim m_b$, where $m_b$ is the mass of a single ball, and $n_{coll} \sim n_b$, where $n_b$ is the number of balls. With the time of the initiation, $t_{init}$, this leads to a constant milling dose, $D_m^*$ corresponding to a certain degree of grain refinement:

$$D_m^* \sim \frac{n_b m_b t_{init}}{m_p} = C_R t_{init} \tag{2}$$

(2)

where the definition for the charge ratio $C_R = n_b \cdot m_b / m_p$ was used. Thus, for a certain degree of refinement, it is expected that $$C_R t_{init} = \text{const.} \tag{3}$$

This reasoning suggests that the milling time required to trigger initiation depends on the diameter of the milling balls exclusively vs. the charge ratio. A similar relation was suggested earlier [F. Delogu, R. Orrhu, G. Cao, *Chemical Engineering Science* 58 (2003) 815-821]. However, the analysis of mechanical alloying processes presented in [F. Delogu, R. Orrhu, G. Cao, *Chemical Engineering Science* 58 (2003) 815-821] was based on a kinetic expression for very low degrees of milling-induced amorphization, and led to the conclusion that for a given milling state $C_R^2 t$, should be constant.

Figure 2:
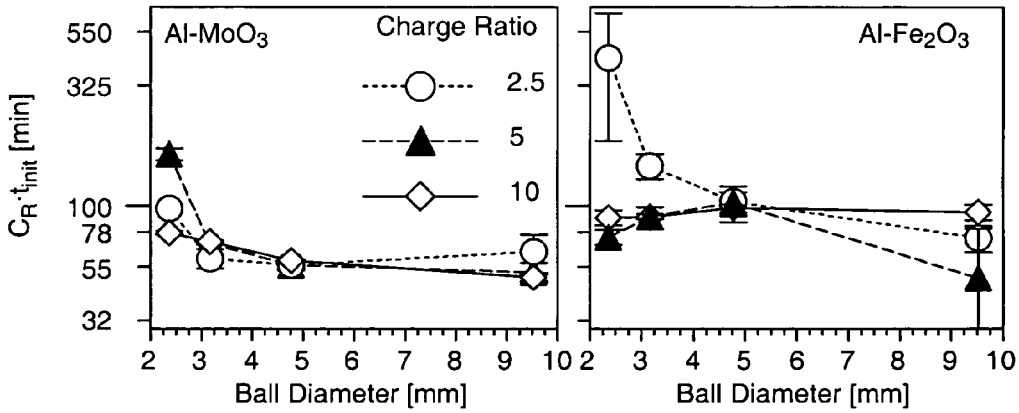
FIG. 2 are graphs of experimental data on reactive milling of Al—$MoO_3$ and Al—$Fe_2O_3$ compositions presented as the product of mixture ratio and milling time plotted versus ball diameter.

The product of the measured milling times leading to initiation and the charge ratios, $C_R t_{init}$, is plotted as a function of the ball diameter in FIG. 2. The values of $C_R t_{init}$ for series with different $C_R$ superimpose and do not change significantly. Thus, to first approximation, the present observations appear to support the tentative trend as expected from Eq. (3), rather than constant values of $C_R^2 t$ as suggested in Delogu, op. cit. Significant deviations from constant behavior predicted by Eq. (3), or even linearity exist, however, especially for smaller ball diameters where milling times are greater than expected. The values of $C_R t_{init}$, are slightly different for Al—$MoO_3$ and Al—$Fe_2O_3$. While it is expected that different materials require mixing of the components on different length scales for initiation to occur, the observed dependence on the ball diameter is not intuitive. Both the achieved degree of structural and compositional refinement and the collision energy determined by the ball diameter could be important for initiation.

EXAMPLE 3

Based on the good reproducibility of the experiments with balls of 4.76 mm diameter, reactive composites were prepared for further analysis with these balls and with $C_R$=5. "Fully milled" materials were milled for 11 and 19 min for the Al—$MoO_3$ and Al—$Fe_2O_3$ mixtures, respectively. "Partially milled" materials were milled for about half the maximum time, 6 and 10 min, respectively. In addition, fully reactive B—Ti nano-composite powders were prepared by milling elemental B and Ti powders in steel vials for 150 min using steel balls with diameters of 4.76 mm and a $C_R$ of 5. Thermite powder blends were prepared by manually homogenizing the starting materials under acetone for reference tests.

Materials Properties

Figure 3:
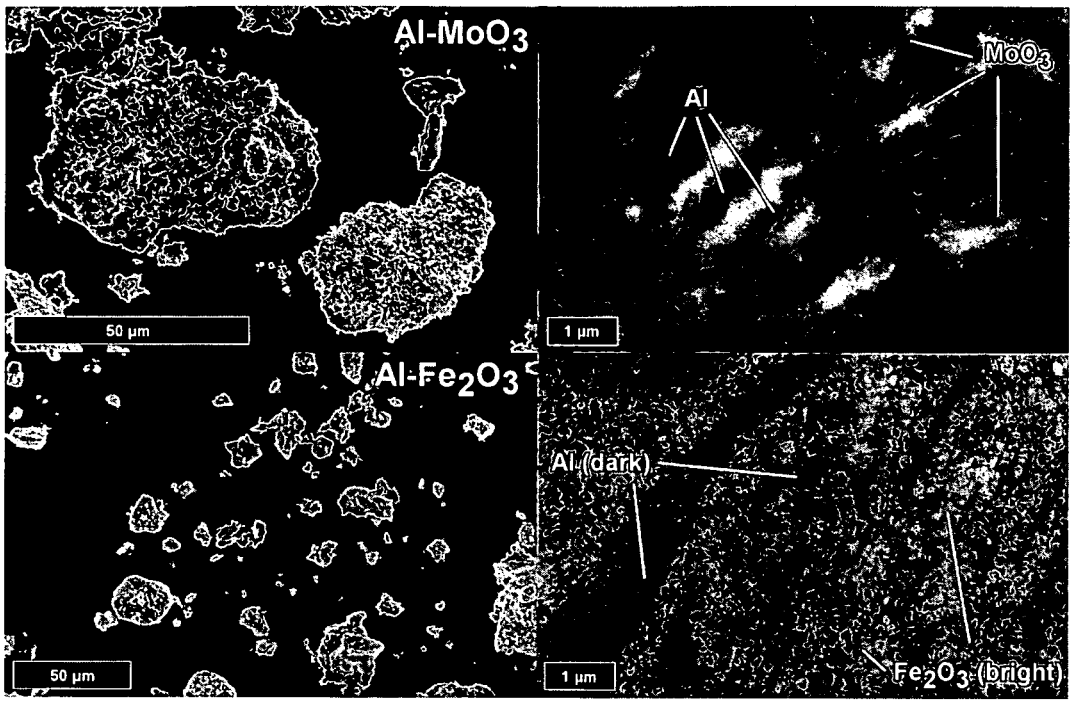
FIG. 3 shows SEM images of the prepared reactive nano-composite powders and respective particle cross-sections.
Figure 4:
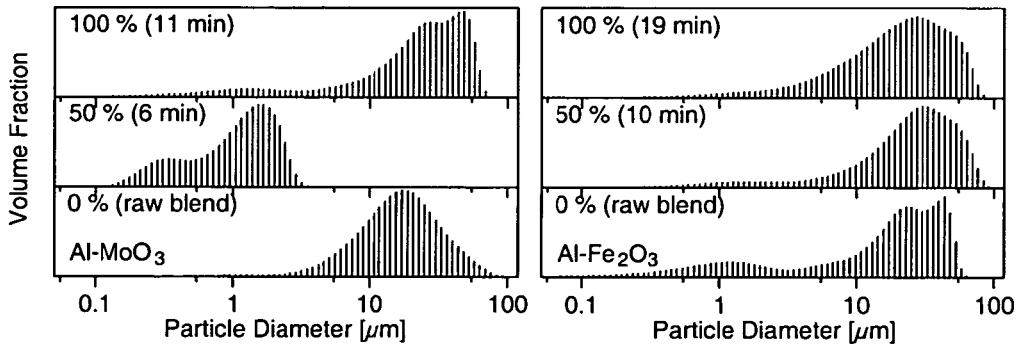
FIG. 4 depicts graphs for particle size distributions of partially and fully milled nanocomposite powders. Unmilled blends of starting materials are shown for comparison.

SEM images of the fully milled nano-composite particles and particle cross-sections are shown in FIG. 3. The particles' surface morphology is typical for mechanically alloyed powders. The images of the particle cross-sections show that the initially spherical Al is thinned out to layers of 10-100 nm thickness sandwiched between layers ($MoO_3$) or nanosized particles ($Fe_2O_3$) of oxidizer. XRD showed no structural changes in either Al or the respective oxides, although noticeable peak broadening was observed for all materials indicating a reduction in crystallite sizes. Particle size distributions measured using LALLS are shown in FIG. 4. While the shape of the distribution changes, the average particle size of the reactive composite is close to the size of the starting materials. The size reduction implied by the LALLS data for partially milled Al—$MoO_3$ is not supported by direct inspection of the particles by microscopy, however. The partially milled particles are oblate; therefore, the light scattering-based measurement is likely to produce erroneous results. The shapes of the fully milled/reactive particles are sufficiently close to spherical to justify the use of LALLS.

EXAMPLE 4

Preliminary Ignition and Combustion Testing

Figure 5:
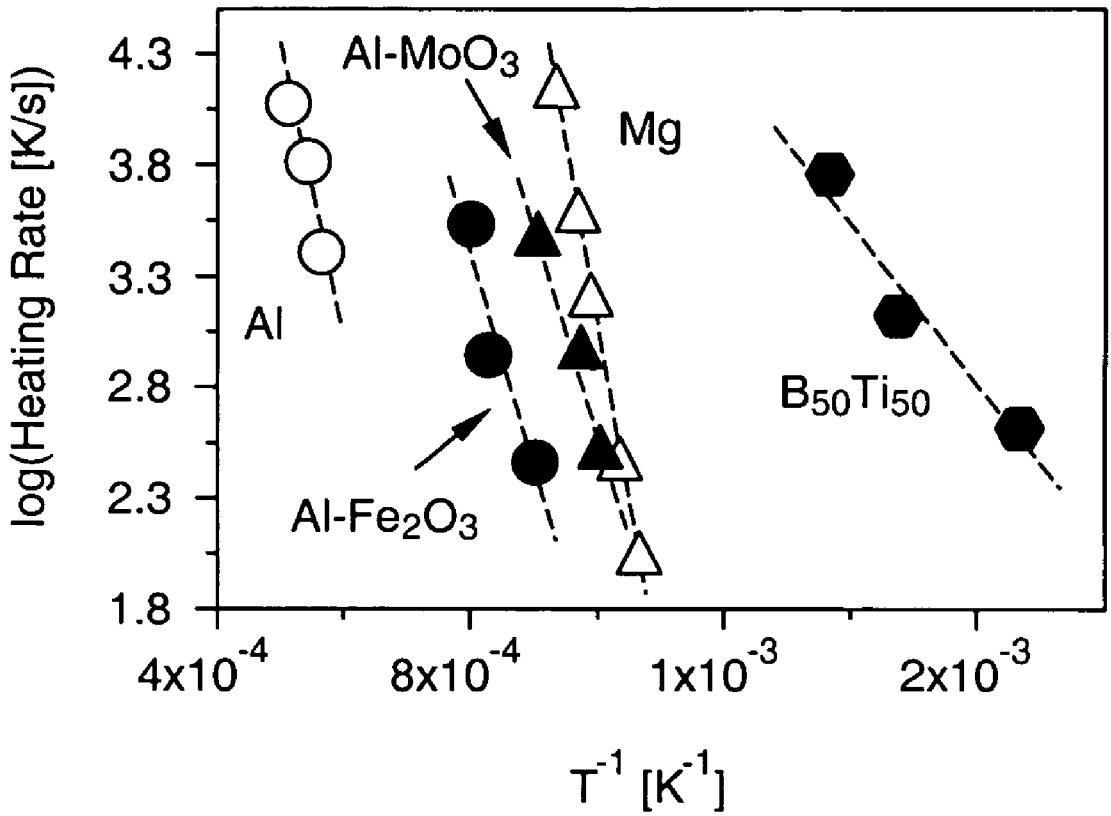
FIG. 5 is an arrhenius plot of ignition temperatures of the fully milled Al—$MoO_3$, Al—$Fe_2O_3$, and B—Ti nano-composites presented in Table 2 herein. Similarly measured data for ignition of Al and Mg powders in air are also shown.

Ignition temperatures measured at different heating rates for the three types of fully reactive nanocomposite materials prepared using ARM are shown in Table 2. These data, processed using an isoconversion method [M. J. Starink, *Thermochimica Acta* 288 (1996) 97-104] to estimate the ignition activation energy, are plotted in FIG. 5. For comparison, similarly measured and processed experimental data describing ignition of pure Al and Mg powders in air [M. A. Trunov, M. Schoenitz, E. L. Dreizin, *Chemical and Physical Processes in Combustion*. The 2003 Technical Meeting of the Eastern States Section of the Combustion Institute University Park, Pa., (2003) pp. 313-316; S. Mohan, M. A. Trunov, E. L. Dreizin, *Chemical and Physical Processes in Combustion*. The 2003 Technical Meeting of the Eastern States Section of the Combustion Institute University Park, Pa., (2003) pp. 329-332] are also shown in FIG. 5. The activation energies for ignition of pure Al and Mg powders in air are close to 215 kJ/mol and are noticeably higher than those measured for the thermites and B—Ti nano-composites. The evaluated activation energies for the Al—$Fe_2O_3$ and Al—$MoO_3$ nano-composites are 170±25 kJ/mol and 152±19 kJ/mol, respectively, and are close to each other. These values are close to the activation energy of 167.5 kJ/mol reported for the Al—$Fe_2O_3$ thermite reaction in [E. I. Maximov, A. G. Merzhanov, V. M. Shkiro, *Zhurnal Fizicheskoi Khimii* 40(2) (1966) 467-470 (in Russian)]. The activation energy for ignition of B—Ti nano-composites is significantly lower, 59±15 kJ/mol. In general, the activation energies are expected to be unaffected by the nano-composite mixing of the ingredients using ARM. However, the activation energies of the thermite compositions prepared by mixing passivated nano-powders could be somewhat higher due to the passivating (e.g., oxide) layers.

TABLE 2

Ignition temperatures of fully milled Al—$MoO_3$, Al—$Fe_2O_3$ and B-Ti nano-composites.

| Heating Rate, K/s | Ignition Temperature, K |
|---|---|
| Al—$MoO_3$ | |
| 3096 | 1104 |
| 972 | 1027 |
| 340 | 995 |
| Al—$Fe_2O_3$ | |
| 3438 | 1249 |
| 883 | 1207 |
| 291 | 1110 |
| $B_{50}Ti_{50}$ | |
| 412 | 600 |
| 1335 | 678 |
| 5732 | 732 |

EXAMPLE 5

Figure 6:
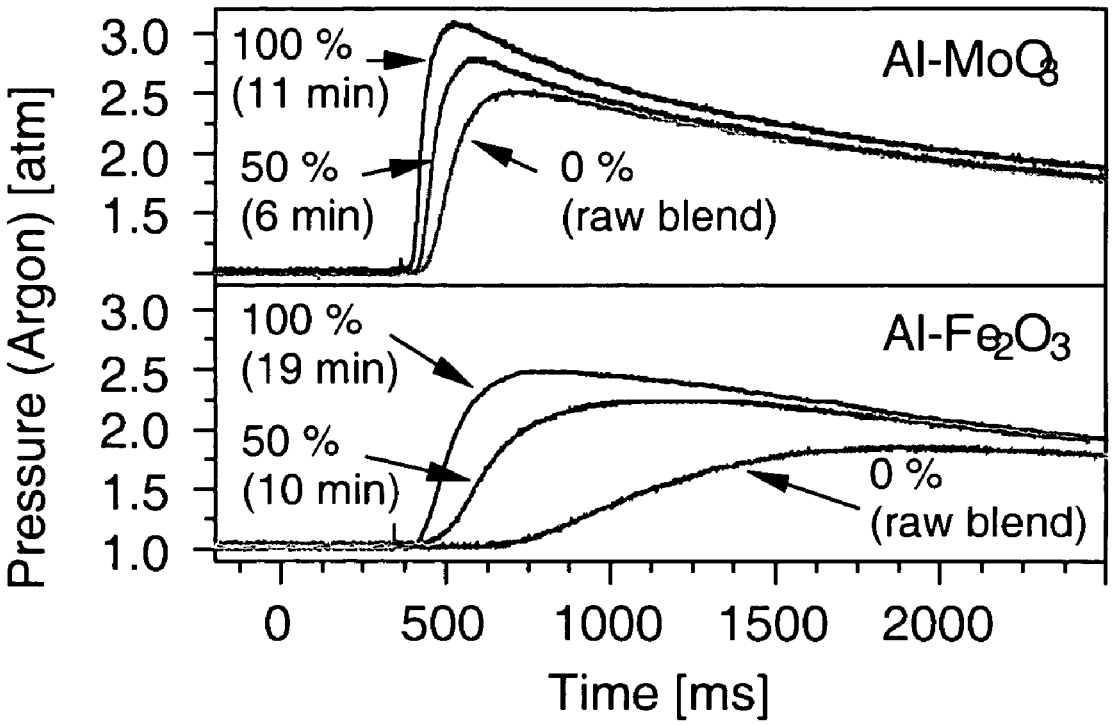
FIG. 6 shows pressure traces recorded in the constant volume explosion experiments in air with the loaded fully and partially milled Al—$MoO_3$ and Al—$Fe_2O_3$ nano-composite powders. The summary of the measured pressures and rates of pressure rise are given in Table 3 herein.

Pressure traces measured in the constant volume explosion vessel for combustion of different charges of thermite powders are shown in FIG. 6. While only qualitative conclusions can be drawn from the comparisons of the pressure traces measured for different powders, samples were portioned to provide a constant 17.9 kJ of energy (4.50 g for Al—$Fe_2O_3$, and 3.81 g for Al—$MoO_3$ compositions). Powder blends, fully and partially reactive nano-composite powders prepared using ARM with different milling times were used in these tests. A summary of the measured pressures and rates of pressure rise for different samples is given in Table 3. A clear trend of the accelerated reaction rate for ARM-prepared materials is visible from the comparison of the pressure traces shown in FIG. 6 and from the results shown in Table 3. It is also seen that the highest reaction rates are observed for fully milled powders of both, Al—$Fe_2O_3$ and Al—$MoO_3$ thermites. Finally, a higher reactivity for the Al—$MoO_3$ thermites compared to the Al—$Fe_2O_3$ thermites is generally observed.

TABLE 3

Summary of results for the constant volume explosion tests with fully and partially milled nano-composites and with blends of the respective starting materials. Shown are maximum recorded pressure, highest rate of pressure rise, and average rate of pressure rise calculated from the time between ignition and the pressure maximum. The powder charges were selected to maintain a constant theoretical reaction enthalpy for all the samples.

| | $P_{max}$, atm | $(dP/dt)_{max}$, atm/s | $(dP/dt)_{avg}$, atm/s |
|---|---|---|---|
| Al—$MoO_3$, 3.81 g | | | |
| 100% (10 min) | 3.07 | 30 | 18.7 |
| 50% (6 min) | 2.78 | 21 | 12.2 |
| blend | 2.51 | 12 | 7.1 |
| Al—$Fe_2O_3$, 4.50 g | | | |
| 100% (19 min) | 2.48 | 9.3 | 5.6 |
| 50% (10 min) | 2.25 | 4.9 | 2.6 |
| blend | 1.85 | 1.4 | 1.1 |

Figure 7:
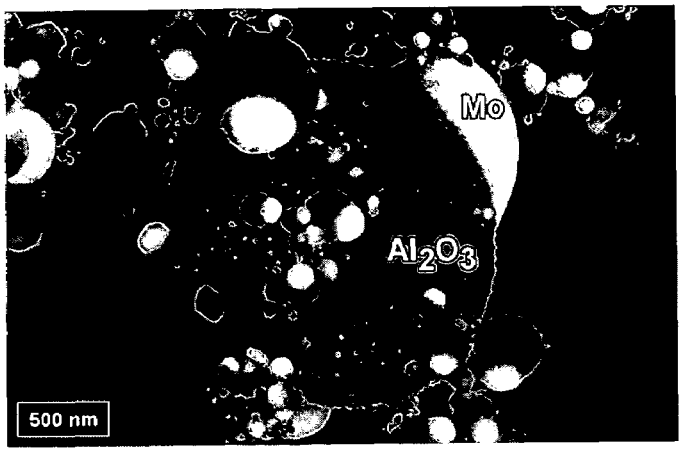
FIG. 7 is a backscattered electron image showing combustion products of the fully milled Al—$MoO_3$ nano-composite recovered from the constant volume vessel.

The combustion products collected from the pressure vessel were analyzed by SEM and XRD. A representative back-scattered electron image is shown in FIG. 7. Product particles consist of aluminum oxide with caps of the respective reduced metal. This feature appears to be independent of particle size, it is even observed in 10 nm particles in the airborne fraction. XRD showed that the bulk of aluminum oxide found in the Mo products was $\delta^*$-$Al_2O_3$, while it was $\sigma$-$Al_2O_3$ in the Fe products. Small amounts of $\alpha$-$Al_2O_3$ were found in both cases as well. Increasing amounts of unreacted Al and $Fe_2O_3$ were detected in the products of partially milled and unmilled Al—$Fe_2O_3$ composites.

The same pressure vessel has recently been used for constant volume aerosol explosion tests carried out in air with different mechanically alloyed powders [M. Schoenitz, E. L. Dreizin, E. Shtessel, *J. of Prop. and Power* 19(3) (2003) 405-412]. Nano-composites prepared using boron and titanium powders using ARM were made and compared with the respective powder blends. Higher rates of pressure rise were reported for the nano-composite powders and a higher degree of conversion of the metallic powders to oxides was observed. Interestingly, some borides (e.g., TiB or $TiB_2$) were detected in the combustion products of B—Ti powder blends but no borides were found in the combustion products of the ARM-prepared B—Ti nano-composite powders. More details on these experiments are available elsewhere [Schoenitz, Dreizin and Shtessel, op. cit.].

Figure 8:
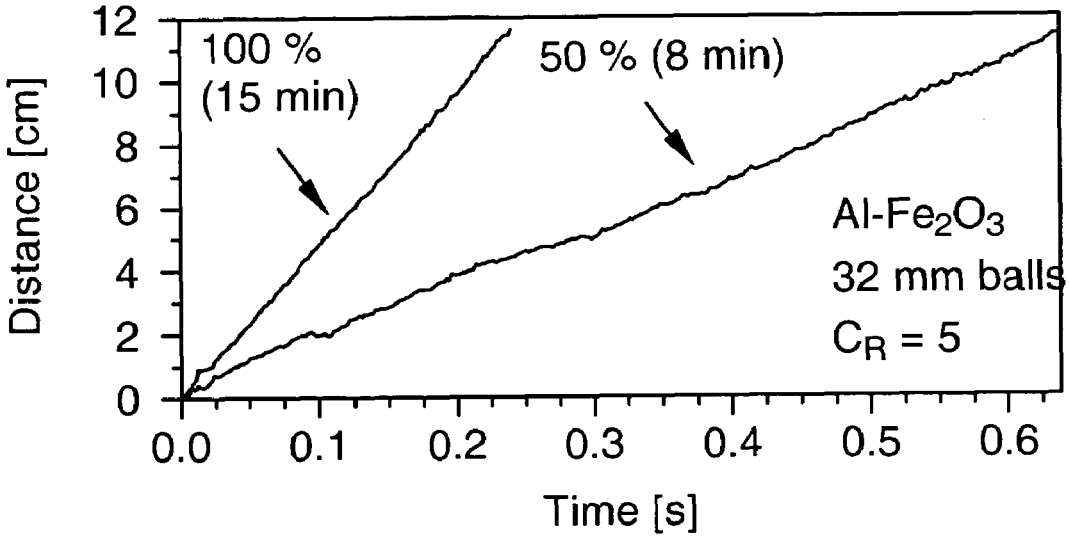
FIG. 8 is a graph depicting results of the linear burn tests conducted with fully and partially milled Al—$Fe_2O_3$ nano-composite powders.

The results of the linear burn measurements for Al—$Fe_2O_3$ nano-composites prepared using ARM with different milling times as well as for the blended Al and $Fe_2O_3$ powders are shown in FIG. 8. The powder blend was successfully ignited, but combustion did not propagate. The propagation was generally faster and the flame speed was more uniform for the powder for which the milling was halted just prior to the expected spontaneous reaction. These results generally confirm that faster reaction kinetics is achieved for materials prepared by ARM.

The foregoing demonstrates that the reactive milling of powders with very high reaction enthalpies can be reproducibly arrested to produce novel energetic material powders with particles in the 1-100 μm size range. Individual particles of these powders are fully dense. The composition of each particle is identical to the bulk powder composition. The components are intimately mixed in three-dimensional nano-structures and ready to react upon initiation. An experimental parametric study of the arrested reactive milling established that for a range of sizes of the grinding balls used, a concept of a milling dose proportional to the product of the milling time and charge ratio can be used to approximately predict the time necessary to prepare the metastable nano-composites. Ignition temperatures of the prepared materials were measured and their activation energies of ignition were evaluated. The activation energy obtained from these experiments for the Al—$Fe_2O_3$ nano-composite is consistent with the known activation energy of the Al—$Fe_2O_3$ thermite reaction. Higher reaction rates were observed in combustion tests conducted in a constant volume pressure vessel in argon for the ARM-prepared nano-composites of both Al—$Fe_2O_3$ and Al—$MoO_3$ as compared to the respective blends of initial powders and partially milled powders. Linear burning rates were observed to increase for the ARM-prepared powders as the time when the reactive milling was arrested approached the expected time of the spontaneous reaction in the milling vial.

While the present invention has been described in terms of specific embodiments thereof, it will be understood in view of the present disclosure, that numerous variations upon the invention are now enabled to those skilled in the art, which variations yet reside within the scope of the present teaching. Accordingly, the invention is to be broadly construed, and limited only by the scope and spirit of the claims now appended hereto.

The invention claimed is:

1. A method for systematically producing an energetic metastable nano-composite material, consisting essentially of: (a) reactively milling a mixture of powdered components that spontaneously react at a known duration of said milling; (b) stopping said milling at a time at which said components are compositionally homogenized on a nanoscale to produce a nanocomposite powder, but prior to said known duration, and thereby before said spontaneous reaction occurs; and (c) recovering as a product the milled powder as a nanostructured composite for subsequent use by controllably initiating destabilization thereof.

2. A method in accordance with claim 1 wherein said milling is effected in a ball mill, and the pre-selected conditions include the number of balls; the ball diameter and ball material; the ratio between the ball diameter and initial volume of said components; the ratio between the mass of balls and the mass of the said components; the material, size, and shape of the milling container; the presence or absence of milling aid compositions; and the mill operating parameters used during said milling.

3. A method in accordance with claim 2 in which said reactive milling is effected in a vibratory mill in which the containers for the products being milled is agitated at high frequency in a complex cycle based on motion in three orthogonal directions.

4. A method in accordance with claim 2 in which said reactive milling is effected in a stirred mill.

5. A method in accordance with claim 2 in which said reactive milling is effected in a planetary mill.

6. A method in accordance with claim 2, wherein said known duration is experimentally determined for said components subjected to milling.

7. A method in accordance with claim 2 wherein the components comprise a metal and an oxidizer for said metal.

8. A method in accordance with claim 2, wherein the components comprise at least a pair of reactive metals.

9. A method in accordance with claim 7, wherein the components comprise at least a pair of thermite reactants.

10. A method in accordance with claim 1, wherein said recovered product comprises particles in the 1-50 μm range.

11. A method in accordance with claim 7 wherein the adiabatic reaction temperature of the components exceeds 1800° K.

12. The method according to claim 1 wherein the energetic metastable nano-composite material is highly reactive.

13. The method according to claim 1 wherein the energetic metastable nano-composite material is compositionally homogenized.

14. A method for systematically producing an energetic metastable nano-composite material, consisting essentially of:

(a) selecting starting components as two or more powdered materials capable of a highly exothermic reaction;

(b) reactively milling said starting components to achieve homogeneity;

(c) stopping said milling at a time at which said components are compositionally homogenized on the nanoscale to produce a nanocomposite powder, but prior to initiation of said exothermic reaction; and (d) recovering as a product the milled powder as a metastable nano-composite for subsequent use by controllably initiating destabilization thereof.

15. The method of claim 1 wherein the milling is performed under pre-selected milling conditions to produce homogeneity.

16. The method of claim 1 wherein the milling is performed under pre-selected milling conditions providing transfer of energy from milling tools to the powdered components required to produce homogeneity.

17. The method of claim 1 wherein the milling is performed under pre-selected milling conditions according to t=const/$C_R$ where t is milling time, $C_R$ is a charge ratio defined as a ratio of mass of milling tools to mass of the powdered components and const is a constant depending upon type of milling equipment.

* * * * *